US006152509A

United States Patent [19]

Hansort

[11] Patent Number: 6,152,509

[45] Date of Patent: Nov. 28, 2000

[54] COUPLING ELEMENT

[75] Inventor: Marinus G. A. Hansort, Goirle, Netherlands

[73] Assignee: Universal Form Clamp, Houston, Tex.

[21] Appl. No.: 09/152,704

[22] Filed: Sep. 14, 1998

[30] Foreign Application Priority Data

Jul. 15, 1998 [NL] Netherlands ..... 1009659

[51] Int. Cl.[7] ..... B66C 1/36; B66C 1/66

[52] U.S. Cl. ..... 294/89; 294/82.23

[58] Field of Search ..... 294/82.17, 82.19, 294/82.22–82.24, 82.3, 82.31, 82.34, 82.35; 52/125.2, 125.4, 125.5

[56] References Cited

U.S. PATENT DOCUMENTS

| | | | |
|---|---|---|---|
| Re. 033,881 | 4/1992 | Courtois et al. | 294/89 |
| 709,572 | 9/1902 | Cowan | 294/82.23 |
| 839,036 | 12/1906 | Roberts | 294/82.31 |
| 1,518,662 | 12/1924 | McKamey et al. | 294/82.31 |
| 1,638,678 | 8/1927 | Bond | 294/82.23 |
| 3,964,777 | 6/1976 | Lindqvist | 294/82.3 |
| 3,965,541 | 6/1976 | Davison | 024/122.6 |
| 4,173,367 | 11/1979 | Haeussler | 294/89 X |
| 4,216,987 | 8/1980 | Ely | 294/82.35 |
| 4,360,230 | 11/1982 | Wood et al. | 294/89 X |
| 4,437,642 | 3/1984 | Holt | 249/175 |
| 4,634,164 | 1/1987 | Fricker | 294/89 |
| 4,664,559 | 5/1987 | Berrang | 294/82.3 X |
| 4,671,554 | 6/1987 | Lancelot | 294/89 |
| 4,930,269 | 6/1990 | Kelly et al. | 294/89 X |

FOREIGN PATENT DOCUMENTS

| | | | |
|---|---|---|---|
| 2382398 | 9/1978 | France . | |
| 2552387 | 5/1977 | Germany | E04G 21/14 |
| 2641273 | 3/1978 | Germany | B66C 1/66 |
| 3415884 | 10/1985 | Germany . | |
| 7802127 | 9/1978 | Netherlands | B66C 1/10 |
| 527364 | 5/1977 | U.S.S.R. | 294/89 |

*Primary Examiner*—Johnny D. Cherry
*Attorney, Agent, or Firm*—Felsman, Bradley, Vaden, Gunter & Dillon, LLP; Frank S. Vaden; Constance Gall Rhebergen

[57] ABSTRACT

The invention relates to a coupling element which can be coupled to a lifting element of an object to be lifted. The coupling element is provided with a remote-controllable locking element, which in a locking position is designed to prevent disconnection of the coupling element and the lifting element connected thereto. A rotatable driving element, which is in engagement with the locking element, is fitted in the inside of the coupling element. The rotatable driving element by means of a control element can take the locking element into or out of the locking position.

10 Claims, 3 Drawing Sheets

COUPLING ELEMENT

TECHNICAL FIELD OF THE INVENTION

The invention relates to a coupling element for coupling to a lifting element of an object to be lifted, which coupling element is provided with a remote-controllable locking element, which in a locking position is designed to prevent disconnection of the coupling element and the lifting element.

PRIOR ART

Such a coupling element is known from FR-2,382,398. The coupling element is used, for example, for moving prefabricated concrete building elements, such as wall parts or floor parts. Anchors are cast in the building elements, an anchor head and a part of the anchor shank of said anchors being left clear in a semi-circular recess in the building element. The dimensions of the coupling element correspond to the dimensions of the recess. The coupling element is provided with an accommodation space, which can accommodate the anchor head. In addition, a slit is made in that part of the periphery of the coupling element adjoining the accommodation space, the width of which slit corresponds to the diameter of the anchor shank. The anchor head is provided with a flanged edge. The coupling element is placed with an accommodation opening over the anchor head and then rotated, so that the anchor head is accommodated in the accommodation space.

A locking pin is fitted in a sliding manner in the coupling element, which locking pin can be slid until it is inside the accommodation space. In a locking position, the pin grips around the flanged edge of the anchor head and in this way prevents the anchor head from being able to slide out of the accommodation space.

The coupling element is provided with an arm, which, when it is resting against a surface of the building element, indicates that the anchor head has slid as far as possible into the accommodation space.

A rotatable lever is also fixed on the arm, the other end of which rotatable lever is fixed rotatably to the locking pin. Cords are fixed at both ends of the lever. By means of a first elastic cord, the locking pin can be placed in a releasing position, and by means of a second cord the coupling element can be rotated to a position in which the coupling element and the anchor head can be disconnected. At a distance from the coupling element the two cords converge, so that they go as a single cord to an operating person.

The first cord and the second cord each form an angle of less than 90° with the lever.

A disadvantage of the known lifting assembly is that the locking pin can be moved into the releasing position only when the locking pin has been taken out of engagement with the anchor head.

Another disadvantage of the known lifting assembly is that the force for taking the locking pin into the releasing position causes a moment on the locking pin. This results in an increased friction force between the locking pin and the coupling element, which makes it difficult to move the locking pin into the releasing position.

Besides, the known lifting assembly has two cords for allowing the coupling element to be remotely unlocked and disconnected.

OBJECT OF THE INVENTION

An object of the present invention is to provide a coupling element in which the force exerted on the locking pin while it is being taken into the releasing position is substantially directed according to the lengthwise direction of the locking pin.

SUMMARY OF THE INVENTION

This object is achieved by a lifting assembly of the type mentioned in the preamble, wherein a rotatable driving element, which is in engagement with the locking element and by means of a control element can take the locking element into or out of the locking position, is fitted in the inside of the coupling element.

With such a lifting assembly, the locking element is easy to take into the releasing position, and no transverse forces which can increase the friction resistance are exerted on the locking element.

The locking element is preferably fitted in the coupling element in such a way that the force exerted on the control element in order to take the locking element into the releasing position causes a moment on the coupling element by means of which the coupling element can be disconnected from the lifting element.

DESCRIPTION OF THE DRAWINGS

These and other advantages will emerge more clearly from the detailed description which follows of a preferred embodiment of the lifting assembly according to the invention with reference to the appended drawing, in which:

FIG. 1 shows a preferred embodiment of a lifting assembly 1 according to the present invention. The lifting assembly 1 comprises a gripping element 2 and a coupling element 3. The gripping element 2 is composed of two parts, a link 5 and a substantially U-shaped bracket 4. The bracket 4 is inserted through an aperture 40 (see FIG. 2) in the coupling element 3 and fixed to the link 5. The link 5 can be pushed over a lifting hook (not shown) of a lifting device. The bracket 4 can rotate freely in the aperture 40 made in the coupling element 3. The coupling element 3 has a circular contour, and the orientation of the axis of the aperture 40 corresponds to an axis of rotation of the coupling element 3 when the coupling element is coupled to a lifting element, for example an anchor 6.

Figure 1:
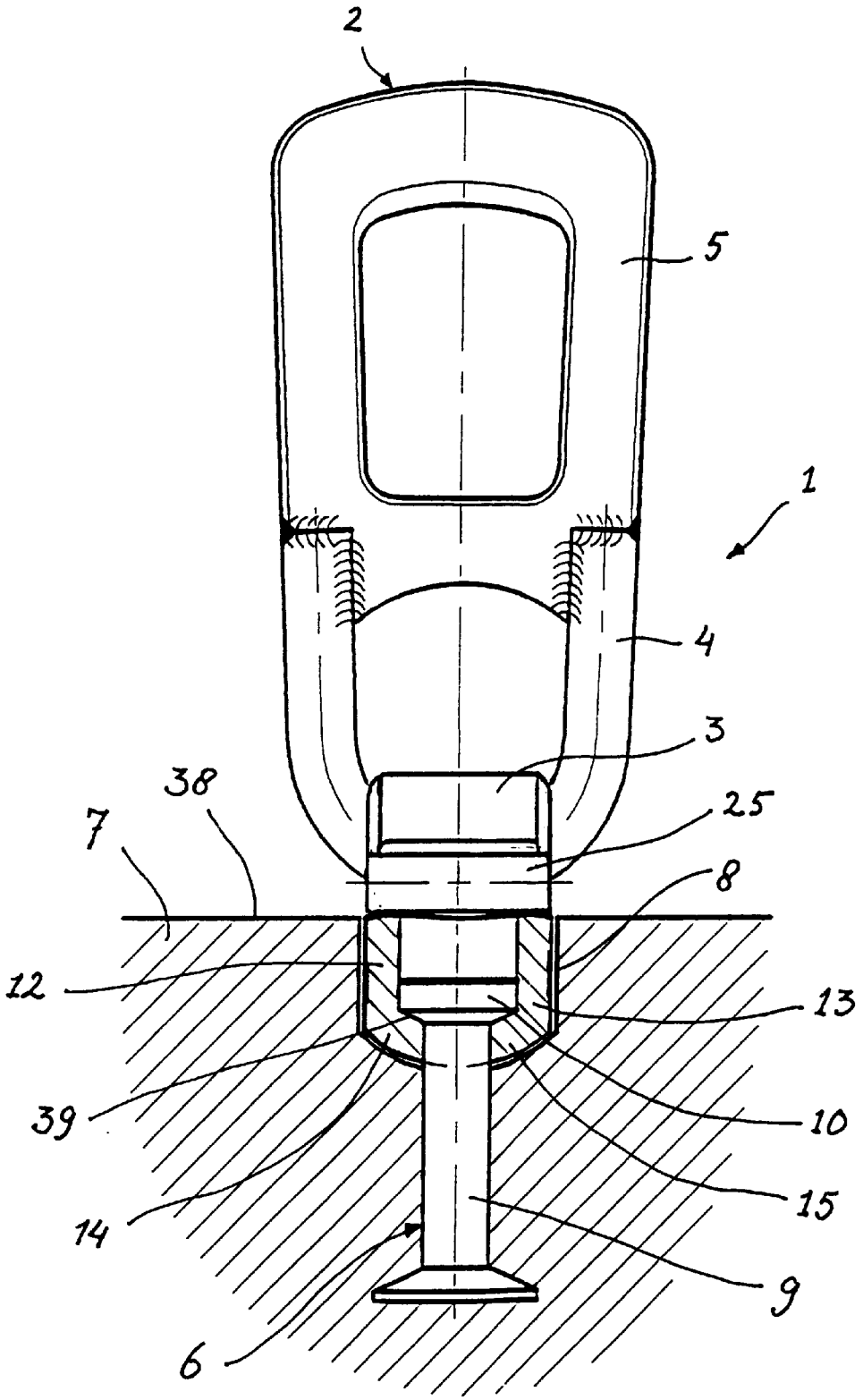
FIG. 1 is a view, partially in section, of a lifting assembly according to the invention, coupled to an anchor.

The anchor 6 is cast in, for example, a building element 7, such as a wall part or a floor part of concrete. The anchor 6 has an anchor shank 9, a free end of the anchor shank 9 being provided with an anchor head 10 with a flanged edge 39. The anchor head 10 and a part of the anchor shank 9 are situated in a niche 8 formed in the surface 38 of the building element 7. The shape of the niche 8 is such that the coupling element 3 can be accommodated at least partially in the niche 8, in which case the coupling element 3 acts upon the anchor 6. For this purpose, the coupling element 3 is provided with an accommodation space 11, in which the anchor head 10 can be accommodated. The accommodation space 11 in the inside of the coupling element 3 is bounded by side walls 12, 13 which are at a distance from each other which is greater than the diameter of the anchor head 10. Supporting edges 14, 15 which face each other are formed on the side walls 12, 13. The supporting edges 14, 15 define a slit 42, the width of which corresponds to the diameter of the anchor shank 9. In the coupled state the anchor head 10 is supported at its flanged edge 39 by the supporting edges 14, 15.

Figure 2:
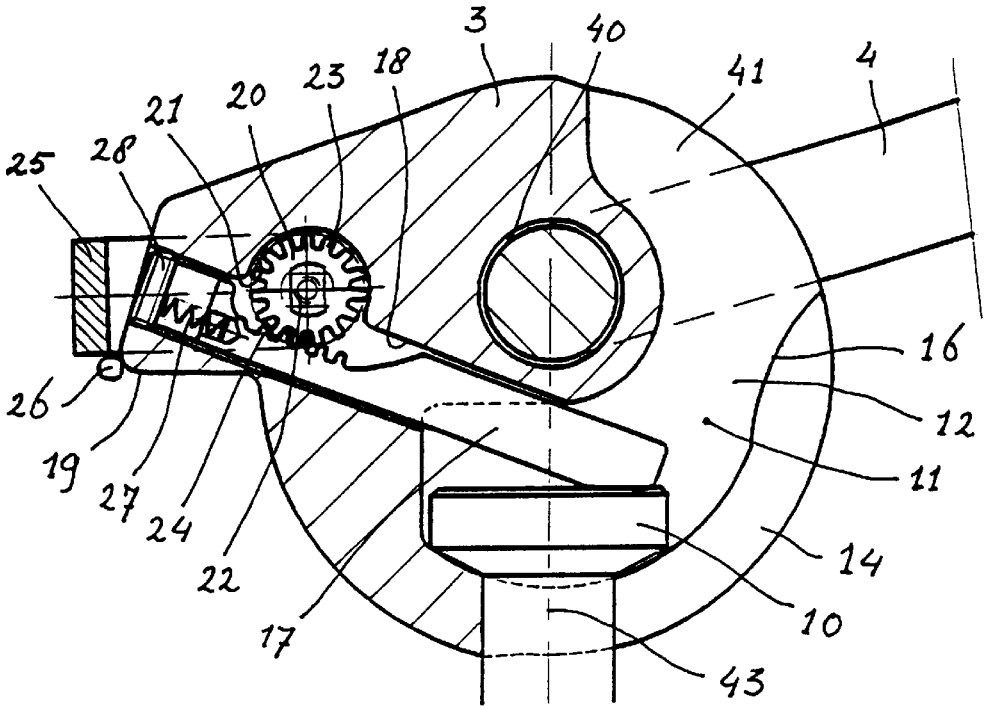
FIG. 2 is a partial view in section of the coupling element according to the invention, with the locking element in the locking position.

It can be seen in FIG. 2 that the accommodation space 11 at one side has an access 41 which is provided on the periphery of the circular contour of the coupling element 3. The accommodation space 11 is shut off at the other side. The access 41 to the accommodation space 11 has such dimensions that the anchor head 10 can be pushed easily into the accommodation space 11. Near the access 41 a threshold 16 is provided on the supporting edges 14, 15, which threshold prevents the anchor head 10 from being able to be pushed too readily out of the accommodation space 11. The coupling element 3 is provided with a lip 19 which rests against the surface 38 of the building element 7 when the coupling element 3 is coupled to the anchor 6. When the lip 19 is resting against the surface 38 this is an indication that the anchor head 10 has been pushed as far as possible into the accommodation space 11. If no tensile forces are being exerted on the coupling element 3, the coupling element will rotate under the influence of the weight of the lip 19, to the left in FIGS. 2–5.

A locking element in the form of a bolt 17 is provided in the coupling element 3, which bolt is slidable in its lengthwise direction in a bore 18 provided in the coupling element 3. The bolt 17 is preferably round.

The bore 18 in the embodiment shown extends through the lip 19 in the direction of the accommodation space 11 and in a plane at right angles to the axis of the coupling element 3, and opens out into the accommodation space 11. The direction of the bore 18 is selected in such a way that the bolt 17 pushed into the bore can rest in a locking position against the front face of an anchor head 10 fitted in the accommodation space 11. In the state of the anchor head 10 pushed to its fullest extent into the coupling space 11, the bolt 17 in the locking position rests against the anchor head 10 at the side of the axis 43 of the anchor 6 furthest away from the bore 18, as clearly shown in FIG. 2. During operation, the coupling element 3 is coupled to the anchor 6 of the building element 7. If the building element 7 is a wall part which has to be moved, for example, from a horizontal conveyance position to a vertical mounting position, the bracket 4 rotates relative to the coupling element 3 from a position in line with the anchor 6 (see FIG. 1) to a position such as that shown in FIG. 2. As a result of the friction force between the bracket 4 and the coupling element 3, the coupling element 3 would also be inclined to rotate. This rotation of the coupling element 3 is prevented by the bolt 17 resting against the anchor head 10.

In order to allow the bolt 17 to be taken into the releasing position, a driving element 20 is fitted in the inside of the coupling element 3. The coupling element 3 is provided with a drilled hole 21 at right angles to the lengthwise direction of the bolt 17 and parallel to the axis of rotation of the coupling element 3. The driving element 20, which in the embodiment shown comprises a shaft 22 with a gearwheel 23 fitted thereon, is placed in the drilled hole 21. The teeth of the gearwheel 23 mesh with a gear rack 24 fitted on the bolt 17. The bolt 17 and the driving element 20, together with a lever 25 provided on the shaft 22, form a locking mechanism of the lifting assembly.

The free ends of the shaft 22 project beyond the coupling element 3. The substantially U-shaped lever 25 acts upon the free ends of the shaft 22. The shaft 22 with the gearwheel 23 provided thereon can be rotated by means of the lever 25. The rotating movement of the driving element 20 is converted by means of the gear rack 24 into an axial movement of the bolt 17. A stop 26 is fitted on the coupling element 3, so that the lever 25 cannot rotate past the lip 19. In addition, the axial movement of the bolt 17 is thereby limited in the direction of the accommodation space 11 when no anchor head 10 has been pushed into the accommodation space 11.

In the locking position shown in FIG. 2 the bolt 17 is pushed by means of a resilient element 27 in the direction of the anchor head 10. In the embodiment shown, the resilient element 27 is in the form of a coil spring 27, which is placed in a recess in a front end face of the bolt 17 facing away from the accommodation space 11 and rests with the other side against a closure cap 28 which closes off the bore 18.

Owing to the fact that the bore 18 can be closed off by the closure cap 28, the locking mechanism is less susceptible to soiling. This has a beneficial effect on the reliability and the ease of operation of the locking mechanism.

Figure 3:
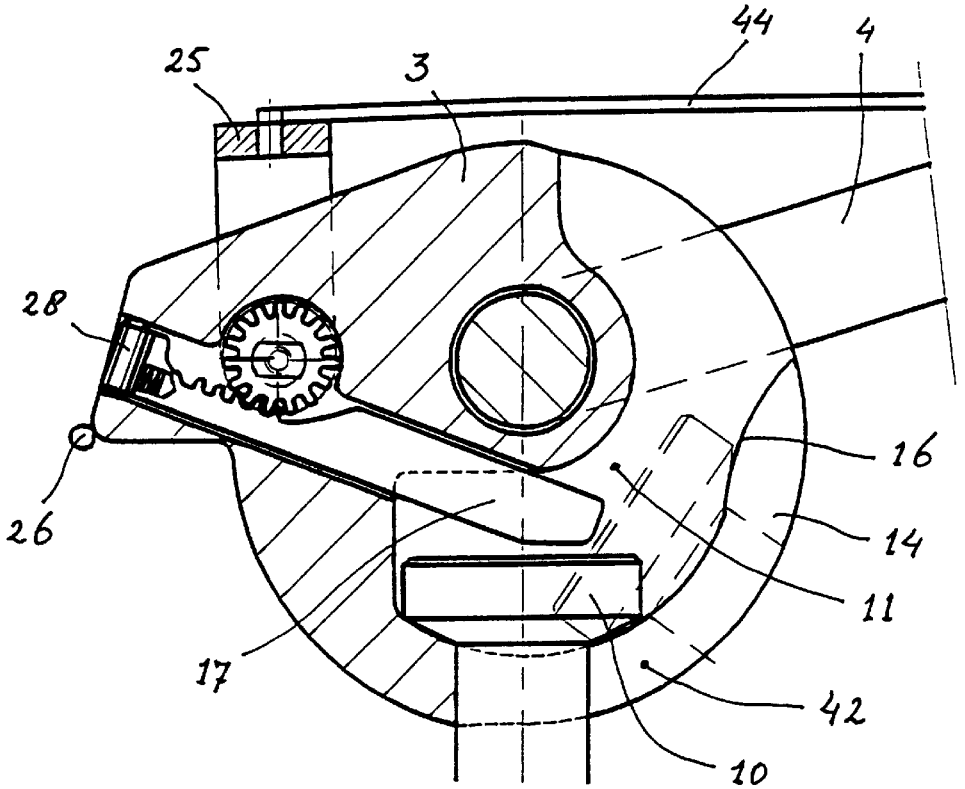
FIG. 3 is a partial view in section of the coupling element according to the invention, with the locking element in the releasing position.

FIG. 3 shows the bolt 17 in a releasing position, in which the coupling element 3 can be disconnected from the anchor 6. The releasing position is reached by turning the lever 25 away over the lip 19 until the bolt 17 goes against the closure cap 28. The bolt 17 has now been drawn back so far out of the accommodation space 11 that the coupling element 3 can rotate. In doing so, the coupling element 3 assumes the position relative to the anchor head 10 shown by a dashed line in FIG. 3. If a tensile force is now exerted by means of the bracket 4 on the coupling element 3 in a direction according to the axis of the anchor 6, the anchor head 10 cannot slide over the threshold 16. Only when the tensile forces have been taken away completely can the anchor head 10 slide out of the aperture, and the coupling element 3 is disconnected from the anchor 6. The threshold 16 thus provides an additional safety mechanism against accidental disconnection of the coupling element 3.

The disconnection can be made by hand by operating the lever 25 and rotating the coupling element 3. In a preferred embodiment a cord 44 is fixed to the lever 25, which cord is guided by means of the gripping element 2 to an operating person. Exerting a tensile force on the cord 44 causes the lever to rotate into the position shown in FIG. 3. This takes the bolt 17 into the releasing position. When the rotating movement of the lever 25 is blocked, the tensile force exerted by way of the cord 44 on the lever 25 causes a moment on the coupling element 3. This will cause the coupling element 3 to rotate into the position in which the coupling element 3 and the anchor 6 can be disconnected. So only one cord 44 is needed to bring about both the release and the disconnection. In this way, automatic release and disconnection are possible.

The bolt 17, the driving element 20 and the lever 25 are placed in such a way that the cord 44, by means of which a force can be exerted remotely on the lever 25 in order to take the bolt 17 out of the locking position, can also be used to rotate the coupling element 3 in such a way that the coupling element 3 can be disconnected from the anchor 6.

Figure 4:
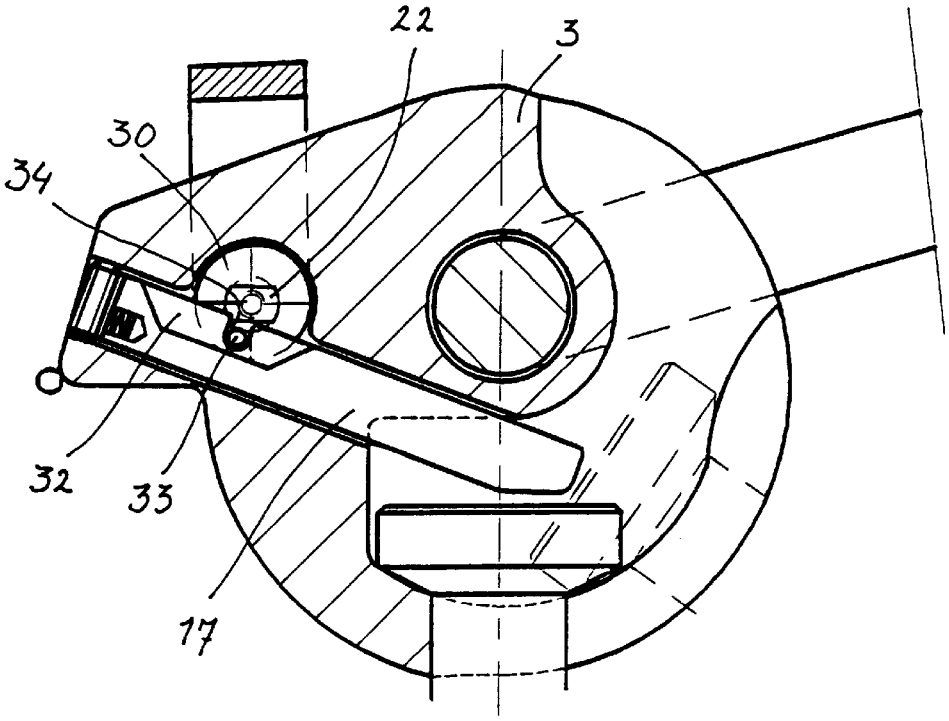
FIG. 4 is a partial view in section of another embodiment of the coupling element according to the invention.

FIG. 4 shows a variant of the driving element 20. Two parallel projections 30 are fitted on the shaft 22, only the projection 30 of which is shown in FIG. 4. The projections 30 are placed at a distance from each other, the distance between the projections 30 corresponding to the width of a cam 32 provided on the bolt 17. A pin 33, which can be accommodated movably through a slit 34 made in the cam 32, is placed between the ends of the projections 30 situated radially the furthest outwards relative to the shaft 22. Rotation of the driving element 30 through a predetermined angle causes the axial movement of the bolt 17.

Figure 5:
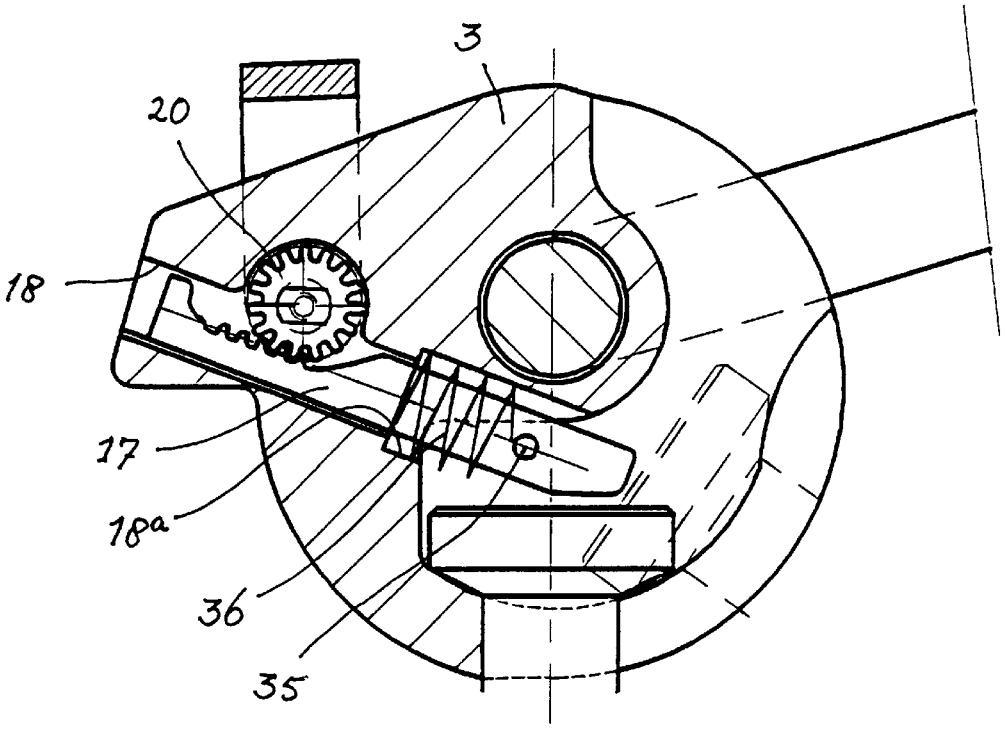
FIG. 5 is a partial view in section of yet another embodiment of the coupling element according to the invention.

FIG. 5 shows a different method for fitting a resilient element which is suitable for pressing the bolt 17 to the locking position. The resilient element consists of a coil spring 36 which for fitting of the bolt 17 is pushed over the bolt 17. The bolt 17 is provided with at least one laterally extending projection 35 against which the coil spring 36 rests. The bolt 17 is placed in the bore 18 by way of the slit formed between the supporting edges 14, 15 and the accommodation space 11. The bore 18 is widened at the end 18A facing the accommodation space 11, in order to enable it to accommodate the coil spring 36. The transition from the end 18A to the bore 18 forms a seat for the coil spring 36.

With the lifting assembly according to the invention it is ensured that the coupling element 3 will not rotate relative to an anchor 6 connected thereto if during a lifting action the bracket 4 and the link 5 rotate relative to the coupling element 3 in the direction corresponding to the direction for disconnecting the coupling element 3 and the anchor 6. In addition, with the lifting assembly according to the invention remote unlocking and disconnection of the coupling element 3 are ensured in a simple manner with a single control line.

An additional advantage of the locking mechanism is that removing the tension from the cord 44 for automatic remote operation of the locking mechanism takes the bolt 17 back into the locking position. Removing the tension occurs at the end of the disconnection action when the anchor head 10 is situated near the access 41 to the accommodation space 11. The bolt 17 now prevents the anchor head 10 from sliding back into the accommodation space 11.

The embodiments described above are given as non-limiting examples. It will be clear to a person skilled in the art that various changes and modifications of the exemplary embodiments are possible without thereby departing from the scope of the invention as defined in the appended claims.

For example, it is possible to combine the embodiments shown in FIGS. 4 and 5 to form a new embodiment.

It is also possible to provide a resilient element on the outside of the lever 25, by means of which the bolt 17 is pushed into the locking position.

Another possibility is to fit a helical spring over the shaft 22, which helical spring acts in such a way that the bolt 17 is forced to the locking position.

What is claimed is:

1. Coupling element for coupling to an object to be lifted, wherein said object is provided with an anchor having an anchor shank and an anchor head at its free end, the anchor head having a width larger than the width of the anchor shank, the coupling element comprising:

a body with an aperture for accommodating a bracket of a gripping element, such that the coupling element can rotate freely with respect to such bracket;

an accommodation space in the interior of said body for accommodating the anchor head;

side walls defining a boundary of said accommodation space;

supporting edges formed on said side walls for supporting the anchor head, said supporting edges defining a slit in the periphery of said body for accommodating the anchor shank, the slit having a width smaller than the width of the anchor head;

a remote-controllable locking bolt, which is arranged slidably in its lengthwise direction in a bore provided in said body, wherein said locking bolt can slidably be displaced between a release position and a locking position in which a free end of said locking bolt can rest against a front face of an anchor head accommodated in said accommodation space in order to prevent rotation of said body with respect to said anchor head;

a rotatable driving element, which is fitted in the interior of said body, and which is in engagement with said locking bolt; and a control element for rotating said driving element.

2. Coupling element according to claim 1, wherein the driving element is a gearwheel which meshes with a gear rack fitted on the locking bolt.

3. Coupling element according to claim 1 or 2, further comprising bias means for exerting a bias force on the locking bolt, the bias force directed to the locking position.

4. Coupling element according to claim 3, wherein said bias means is a resilient element.

5. Coupling element according to claim 1 or 2, wherein said control element is a lever which is connected to a shaft of the rotatable driving element.

6. Coupling element according to claim 5, wherein said lever can be operated remotely by means of a cord.

7. Coupling element according to claim 6, wherein said locking bolt and said rotatable driving element are fitted in said body of the coupling element in such a way that the force exerted on the lever by way of the cord necessary for bringing the locking bolt into its releasing position causes a moment on said body in such direction that the coupling element can be disconnected from the anchor.

8. Coupling element according to claim 1 or 2, wherein a threshold is provided on said supporting edges, which threshold can prevent the anchor head from being pushed out of said accommodation space.

9. Coupling element according to claim 1 or 2, wherein said bore in said body has a direction such that, in the locking position, the bolt touches a front face of an anchor head, when accommodated in said accommodation space, at that side of the anchor's axis which is furthest away from the bore.

10. Lifting assembly, comprising a gripping element on which a lifting device can act, and a coupling element according to claim 1 or 2, wherein a bracket of said gripping element is inserted through said aperture in said body and can rotate relative to said body.

* * * * *